US008200420B2

(12) United States Patent
Solyom et al.

(10) Patent No.: US 8,200,420 B2
(45) Date of Patent: Jun. 12, 2012

(54) COLLISION AVOIDANCE SYSTEM IN A VEHICLE

(75) Inventors: Stefan Solyom, Olofstorp Göteborg (SE); Mattias Bengtsson, Billolal (SE)

(73) Assignee: Volvo Car Corporation, Gothenburg (SE)

( * ) Notice: Subject to any disclaimer, the term of this patent is extended or adjusted under 35 U.S.C. 154(b) by 488 days.

(21) Appl. No.: 12/556,860

(22) Filed: Sep. 10, 2009

(65) Prior Publication Data

US 2010/0070148 A1 Mar. 18, 2010

(30) Foreign Application Priority Data

Sep. 10, 2008 (EP) ..... 08164064

(51) Int. Cl.
*G08G 1/16* (2006.01)

(52) U.S. Cl. ..... 701/301; 701/70; 180/271

(58) Field of Classification Search ..... 701/70, 701/301; 180/167, 169, 271
See application file for complete search history.

(56) References Cited

U.S. PATENT DOCUMENTS

| | | | | |
|---|---|---|---|---|
| 2006/0217866 | A1* | 9/2006 | Moebus | 701/70 |
| 2008/0167781 | A1* | 7/2008 | Labuhn et al. | 701/48 |
| 2008/0183360 | A1* | 7/2008 | Zhang et al. | 701/70 |

* cited by examiner

*Primary Examiner* — Paul N Dickson
*Assistant Examiner* — Timothy Wilhelm
(74) *Attorney, Agent, or Firm* — Brooks Kushman P.C.

(57) ABSTRACT

A method for determining the time to collision between a host vehicle and an oncoming target vehicle, and for determining the necessary host vehicle deceleration for bringing the host vehicle to a standstill at the moment of collision. The method furthermore comprises the steps: determining the position ($p_H$) of the host vehicle as a function of time; determining the position ($p_T$) of the target vehicle as a function of time; for the moment of collision, as a first condition, setting the position ($p_H$) of the host vehicle equal to the position ($p_T$) of the target vehicle, and, as a second condition, setting the velocity ($v_H$) of the host vehicle to zero; using the positions and the conditions above to solve for the time to collision and the necessary host vehicle deceleration; and choosing the solution for time to collision that is positive and has the largest value.

9 Claims, 2 Drawing Sheets

COLLISION AVOIDANCE SYSTEM IN A VEHICLE

CROSS-REFERENCE TO RELATED APPLICATION

This application claims foreign priority benefits under 35 U.S.C. §119-(a)-(d) to EP 08164064.1 filed Sep. 10, 2008, which is hereby incorporated by reference in its entirety.

BACKGROUND

1. Technical Field

The present invention relates to passenger vehicle collision mitigation systems, and more specifically to a method for determining the time to collision between a host vehicle and an oncoming target vehicle, and for determining the necessary host vehicle deceleration for bringing the host vehicle to a standstill at the moment of collision.

2. Background Art

As technology evolves and different sensors become more and more affordable, it is natural that traffic safety should profit considerably of this development. One type of safety system includes those oriented towards collision avoidance and/or mitigation by braking. Such systems generally comprise one or more sensors for detecting the external environment, usually being connected to a brake control management unit.

In the following, a host vehicle is defined as a vehicle for which a collision avoidance/mitigation system is active, and a target vehicle is a vehicle which the host vehicle is approaching and for which the host vehicle must brake in order to avoid or mitigate a collision.

Currently, most such systems are designed to avoid or mitigate collisions with receding vehicles, i.e. vehicles that are travelling over the road in the same direction as the host vehicle. A forward collision warning system is a known system that issues a warning for both receding and oncoming vehicles. However, this warning is generally issued at high speeds where the most effective single measure for collision avoidance is steering around the target vehicle. There is a conceptual difference between the ability of a vehicle to avoid collision by steering and by braking.

At relatively low velocities it is usually better to brake, and at relatively higher velocities it is generally better to avoid collision by steering. There is a certain velocity at which the two methods are equal, i.e. the velocity at which braking and steering are equally efficient in avoiding a collision, and that velocity is:

$$v = 2a\sqrt{\frac{p_y}{a_y}} \tag{1}$$

where:

v is the vehicle longitudinal speed;

$p_y$ is the width of the object to avoid (considered equal to the width of the host vehicle);

a is the longitudinal acceleration achievable by the host vehicle through braking; and $a_y$ is the maximum lateral acceleration achievable by the host vehicle.

It can be concluded that above this velocity, in order to avoid collision with an obstacle, it is more efficient to steer away from it, while below this velocity threshold it is more efficient to apply the brakes of the host vehicle.

The following discussion addresses the situations where it is more efficient to brake. The situations will be different depending on if the target vehicle is a receding object or an oncoming object. If the target is receding from the host vehicle, then the objective is that both host and target vehicles have the same velocity at the moment of collision. For oncoming target vehicles, the best result for the host vehicle is to reach a standstill at the moment of collision.

In the case of an oncoming target vehicle, to compute the time of impact is rather complex. It is desired to achieve a simple yet exact method to compute the time to collision and the needed host acceleration to avoid or mitigate collision.

SUMMARY

The object of the present invention is to provide a simple, exact method to compute the time to collision and the required host acceleration to avoid or mitigate collision.

The method comprises the steps: determining the position of the host vehicle as a function of time; determining the position of the target vehicle as a function of time; determining whether the target vehicle is travelling toward the host vehicle or away from the host vehicle; as a first condition, setting the position of the host vehicle equal to the position of the target vehicle, and, as a second condition, setting the velocity of the host vehicle to zero if the target vehicle is travelling toward the host vehicle and setting the velocity of the host vehicle equal to a velocity of the target vehicle if the target vehicle is travelling away from the host vehicle; using the positions and the conditions above to solve for a time to collision and a required host vehicle acceleration to be applied over the time to collision in order to avoid collision; and based upon the time to collision, activating a host vehicle braking system to achieve the required host vehicle acceleration.

A number of advantages are obtained by means of the present invention. For example, a simple method for computing the time to collision for oncoming vehicles is obtained. The host vehicle deceleration, required to bring the vehicle to a standstill at the moment of collision is computed.

BRIEF DESCRIPTION OF THE DRAWINGS

The invention will now be described more in detail with reference to the appended drawings, where.

DETAILED DESCRIPTION

Figure 1:
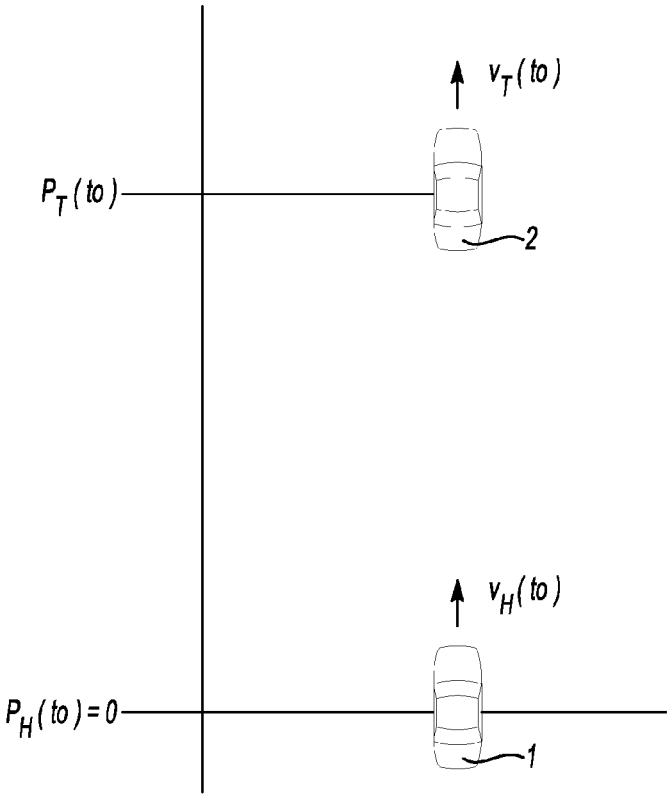
FIG. 1 schematically shows a host vehicle and a target vehicle, where the target vehicle is receding.

With reference to FIG. 1, a host vehicle 1 is initially travelling in the same direction as a target vehicle 2. The host vehicle 1 is a vehicle equipped with a collision mitigation system, and the target vehicle 2 is a vehicle ahead of the host vehicle and detected by the collision mitigation system as presenting a possible collision threat.

The following general equations are valid for a linear case:

$$p(t) = p(t_0) + v(t_0)(t - t_0) + \frac{1}{2}a(t_0)(t - t_0)^2 \quad (2)$$

$$v(t) = v(t_0) + a(t_0)(t - t_0) \quad (3)$$

$$a(t) = a(t_0) = u(t_0) = u \quad (4)$$

where:

p(t) denotes the position at the time t;

v(t) denotes the velocity at the time t; and a(t) denotes the acceleration at the time t.

In the first case that will be considered, the target vehicle 2 is receding, meaning it is travelling away from the host vehicle but the host vehicle is overtaking it such that a collision will occur if no steps are taken to avoid it. The objective in this case is for the host vehicle 1 and target vehicle 2 to reach zero velocity relative to one another at (or prior to) the time at which they meet. In other words, both host 1 and target vehicles 2 will have the same absolute velocity at the moment of collision At initial time $t_0$ the host vehicle 1 is at a position $p_H(t_0)$, is travelling at a velocity $v_H(t_0)$ and has an acceleration $a_H(t_0)$. At the initial time $t_0$ the target vehicle 2 is at a position $p_T(t_0)$, is travelling at a velocity $v_T(t_0)$, and has an acceleration $a_T(t_0)$. The position at the time $t_0$, $p_H(t_0)$, is set to zero, and the following equations are valid:

$$p_T(t) = p_T(t_0) + v_T(t_0)(t - t_0) + \frac{1}{2}a_T(t - t_0)^2 \quad (5)$$

$$p_H(t) = v_H(t_0)(t - t_0) + \frac{1}{2}a_H(t - t_0)^2. \quad (6)$$

The conditions at the time of collision are:

$$p_T(t) = p_H(t), \quad (7)$$

$$v_T(t) = v_H(t) \quad (8).$$

The system of equations formed by the equations (5), (6), (7) and (8) results in the solution:

$$t - t_0 - \frac{2p_T(t_0)}{v_T(t_0) - v_H(t_0)} \quad (9)$$

$$a_H(t_0) = a_T(t_0) - \frac{(v_T(t_0) - v_H(t_0))^2}{2p_T(t_0)}. \quad (10)$$

It is desired to find the parameters t and $a_H(t_0)$, where $a_H(t_0)$ denotes the deceleration that host vehicle 1 must sustain beginning at time $t_0$ in order to avoid a collision.

In practical application, it is likely that a value of $a_H(t_0)$ will be assumed or pre-determined based upon various vehicle performance factors, such as tire/road friction, and the time t then gives the time over which the deceleration $a_H(t_0)$ must be applied. This is of course only an example of how the results may be used practically.

Figure 2:
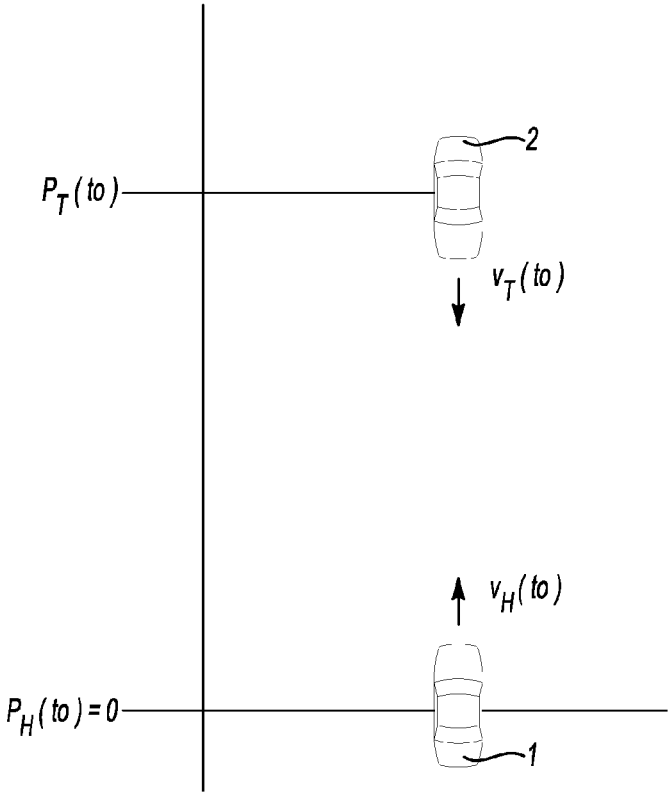
FIG. 2 schematically shows a host vehicle and a target vehicle, where the target vehicle is oncoming.

With reference to FIG. 2, the host vehicle 1 and target vehicle 2 are travelling in opposite direction relative to one another. In this case, the target vehicle is said to be an oncoming vehicle and if a collision is determined to be imminent the desired strategy is to brake the host vehicle 1 such that it reaches a standstill ($v_H$=0) at the expected or predicted moment of collision. It is important to notice that although there is a zero velocity situation implicated in the scenario, it is nevertheless correct to use the equations (5) and (6), since the host will tend to reach zero velocity at the limit.

Up to the point when the velocity becomes zero, where the algorithm is switched off, valid solutions are those given by the equations (5) and (6) with the following conditions at the time of collision:

$$p_T(t) = p_H(t), \quad (11)$$

$$v_H(t) = 0. \quad (12)$$

Notice that in this case, with the reference direction used, the velocity of the oncoming target vehicle 2 is negative. Similarly, the acceleration of the target vehicle 2 is positive if it is braking as it closes with the host vehicle 1 and negative if it is accelerating toward the host vehicle.

The system has at most two solutions. The acceleration of the host vehicle is given by the equation:

$$a_H(t) - v_H(t_0)\xi$$

where:

$\xi$ is the solution of the second order equation:

$$2p_T(t_0)\xi^2 + (v_H(t_0) - 2v_T(t_0))\xi + a_T(t_0) = 0 \quad (13)$$

that is, $$a_{H1,2}(t) = \frac{v_H(t_0)}{4p_T(t_0)}\left(2v_T(t_0) - v_H(t_0) + \sqrt{(v_H(t_0) - 2v_t(t_0))^2 - 8p_T(t_0)a_T(t_0)}\right) \text{ and denote}$$

$$\Delta = (v_H(t_0) - 2v_t(t_0))^2 - 8p_T(t_0)a_T(t_0). \quad (14)$$

The time to collision is given by:

$$t = t_0 + \frac{1}{\xi}$$

that is, $$t = t_0 - \frac{4p_T(t_0)}{2v_T(t_0) - v_H(t_0) \pm \sqrt{(v_H(t_0) - 2v_t(t_0))^2 - 8p_T(t_0)a_T(t_0)}}.$$

Notice that the time to collision has two solutions but only one is valid. In the following it is shown that only one solution is valid and the valid solution is identified.

The first case is that the target vehicle is braking, i.e. it has a positive acceleration with the reference directions used.

The validity is easily checked by looking at the time to stop of the target vehicle. This time is always smaller in absolute value than one of the solutions, which is the incorrect solution. The proof of this is outlined in the following. The target acceleration for which the two solutions are equal is:

$$a_T^0(t_0) = \frac{(v_H(t_0) - 2v_t(t_0))^2}{8p_T(t_0)} \quad (15)$$

the time to stop of the target vehicle is:

$$t_{TStop}^0 = -\frac{v_T(t_0)}{a_T(t_0)} + t_0 = -\frac{8v_T(t_0)p_T(t_0)}{(v_H(t_0) - 2v_t(t_0))^2} + t_0. \quad (16)$$

The solution of the system formed by equations (11) and (12) for the acceleration (15) is:

$$a_H^0(t) = -\frac{v_H(t_0)(v_H(t_0) - 2v_t(t_0))}{4p_T(t_0)},$$

$$t^0 = t_0 + \frac{4p_T(t_0)}{v_H(t_0) - 2v_T(t_0)}.$$

This implies that $$t_{TStop}^0 - t^0 = -\frac{4v_H(t_0)p_T(t_0)}{(v_H(t_0) - 2v_t(t_0))^2} < 0. \quad (17)$$

Moreover, denote $t_+$ and $t_-$ the two roots of the quadratic equation for the collision time, in particular:

$$t_+ = t_0 - \frac{1}{-0} = +\infty, \text{ when } a_T(t_0) = 0 \quad (18)$$

$$t_- = t_0 + \frac{4p_T(t_0)}{2(v_H(t_0) - 2v_t(t_0))}, \text{ when } a_T(t_0) = 0. \quad (19)$$

It is seen that $t_+$ and $t_-$ are monotonically decreasing and increasing in $a_T(t0)$ respectively, from the origin to the point corresponding to $\Delta=0$. This fact, together with equation (17), implies that only $t_-$ is a valid solution.

However, even this solution is valid only on a subset of the domain of the definition with real image. That is, after $t_->t_{TStop}$, the target vehicle 2 comes to a stop and the equations of motion on which the calculation is based are invalid, hence the computed time and acceleration are invalid. In this region, the solution for braking against an oncoming vehicle that comes to a stop should be used.

For negative target acceleration, i.e. the target vehicle 2 is accelerating as it closes with the host vehicle, $t_+$ is negative and thus an invalid solution.

In the case of collision with an oncoming vehicle that comes to a stop, the equations (5) and (6) are no longer valid. The distance to collision, i.e. the distance needed for the target vehicle to stop, is:

$$p_T(t) - p_T(t_0) - \left(\frac{v_T(t_0)^2}{2a_T(t_0)}\right). \quad (20)$$

The equations (6), (11), (12) and (20) form a system of equations that will give the acceleration of the host vehicle, needed such that at the moment of collision it comes to a standstill. The acceleration thus obtained is:

$$a_H(t) = -\frac{v_H(t_0)^2}{2\left(p_T(t_0) - \frac{v_T(t_0)^2}{2a_T(t_0)}\right)}. \quad (21)$$

The solution according to equation (21) is identical with the situation when the target vehicle is travelling in the same direction as the host and comes to a stop.

The time needed for the host to stop is:

$$t_{HStop} = t_0 + \frac{2p_T(t_0)a_T(t_0) - v_T(t_0)^2}{v_H(t_0)a_T(t_0)},$$

which is greater than the time to stop of the target vehicle:

$$t_{TStop} = t_0 - \frac{v_T(t_0)}{a_T(t_0)},$$

if and only if:

$$2p_T(t_0)a_T(t_0) - v_T(t_0)^2 + v_H(t_0)v_T(t_0) > 0. \quad (22)$$

As mentioned above, when considering an oncoming vehicle, the velocity of the target vehicle 2 is negative, and its acceleration is positive while it is braking.

Depending on the type of target vehicle motion (receding or oncoming), the required acceleration of the host vehicle will admit different solutions. This implies that arbitration is needed in order to choose the correct solution. A necessary condition for a collision to occur, given the actual acceleration of both host and target, is:

$$\tilde{v}^2(t_0) - 2p_T(t_0)\tilde{a}(t_0) \geqq 0 \quad (23)$$

with $$\tilde{v} = v_T - v_H$$

and $$\tilde{a} = a_T - a_H.$$

In other words, if equation (23) is not fulfilled, automatic braking is not necessary, as no collision is expected to occur.

Figure 3:
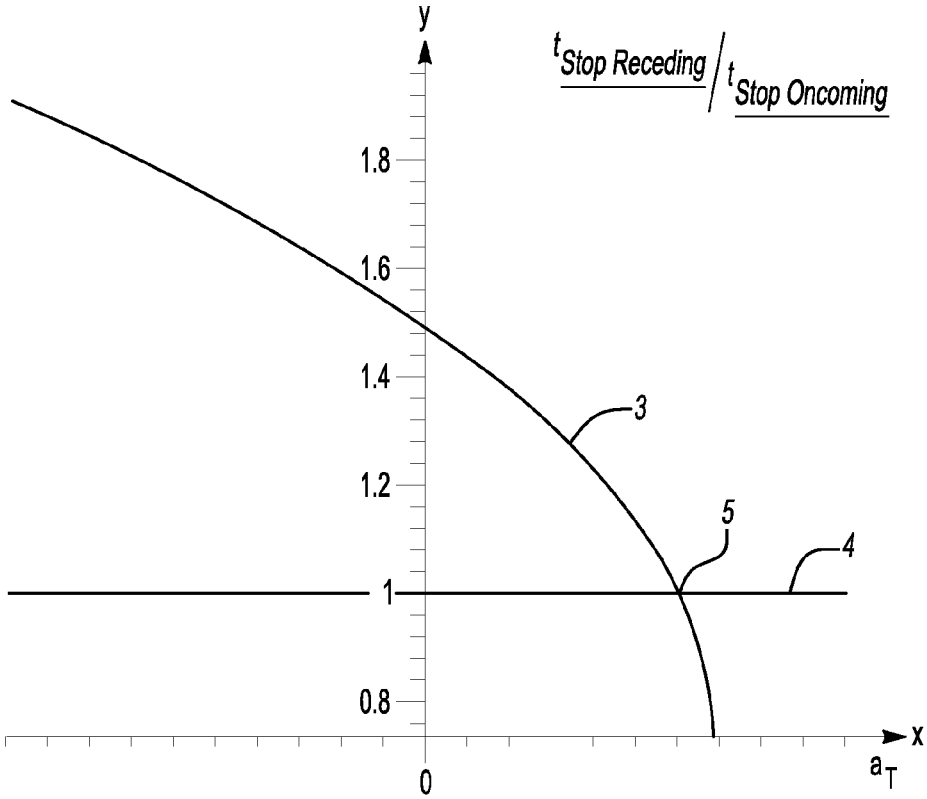
FIG. 3 shows a diagram where target vehicle acceleration is represented on the x-axis, and the ratio between the stop time for a receding vehicle and an oncoming vehicle, $t_{StopReceding}/t_{StopOncoming}$, is represented on the y-axis.

FIG. 3 is a graphical representation of the above. On the x-axis, acceleration of the target vehicle $a_T(t_0)$ is shown and on the y-axis, the ratio between the stop time for a receding vehicle and an oncoming vehicle, $t_{StopReceding}/t_{StopOncoming}$, is shown. A half-parabola 3 represents $t_{StopReceding}/t_{StopOncoming}$ for an oncoming vehicle. A horizontal line 4 represents a limit between where there is a collision and where there is no collision. For values of $t_{StopReceding}/t_{StopOncoming}$ below 1.0, there is no collision, and at the intersection 5 between the half-parabola 3 and the horizontal line 4, there is a limit between collision/no collision.

It is also possible to regard the physical energies in the system. By multiplying equation (23) with m/2 on both sides, m representing mass, one obtains:

$$\frac{m\tilde{v}(t_0)^2}{2} \geq mp_T(t_0)\tilde{a}(t_0)$$

which means that the kinetic energy of the system formed by the two vehicles has to be larger than the potential energy of the system determined by the distance between the vehicles and the relative acceleration between the vehicles.

This relation holds for both receding and oncoming target vehicles.

In the case of oncoming vehicles, one can use $\Delta \geqq 0$ as a necessary condition for collision, according to the definition in equation (22). However, this is not a sufficient condition for a controlled collision with a moving oncoming vehicle. Additional arbitration is needed to determine whether the oncoming vehicle comes to a stop before the moment of collision.

The inequality (22) is in fact also an energy description for the controlled collision with oncoming vehicle that comes to a stop.

Figure 4:
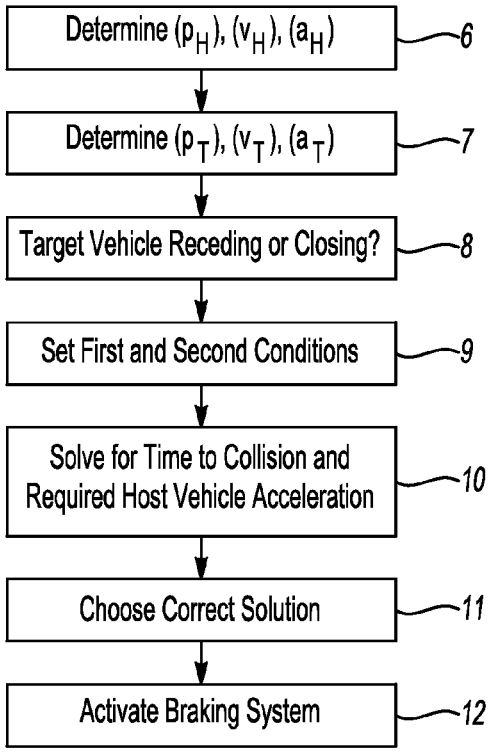
FIG. 4 shows a flowchart for a method according to an embodiment of the present invention.

With reference to FIG. 4, a method for determining the time to collision between a host vehicle 1 and an oncoming target vehicle 2, and for determining the necessary host vehicle deceleration for bringing the host vehicle 1 to a standstill at the moment of collision is presented. The method comprises the following steps:

6: determining the position ($p_H$) and dynamic state ($v_H$, $a_H$) of the host vehicle 1 as a function of time;

7: determining the position ($p_T$) and dynamic state ($v_T$, $a_T$) of the target vehicle 2 as a function of time;

8: determining whether the target vehicle is travelling toward the host vehicle (closing) or away from the host vehicle (receding);

9: as a first conditions, setting the position ($p_H$) of the host vehicle 1 equal to the position ($p_T$) of the target vehicle 2, and, as a second condition, setting the velocity ($v_H$) of the host vehicle to zero if the target vehicle is travelling toward the host vehicle and setting the velocity ($v_H$) of the host vehicle equal to a velocity ($v_T$) of the target vehicle if the target vehicle is travelling away from the host vehicle;

10: using the positions and the conditions above to solve for the time to collision and the necessary host vehicle deceleration;

11: choosing the solution for time to collision that is positive and has the largest value.

12: based upon the time to collision, activating a host vehicle braking system to achieve the required host vehicle acceleration.

The present invention is not limited to the description above, but may vary within the scope of the appended claims.

The invention claimed is:

1. A method for vehicle collision mitigation comprising the steps of:

determining a position of a host vehicle as a function of time;

determining a position of a target vehicle as a function of time;

determining whether the target vehicle is travelling toward the host vehicle or away from the host vehicle;

as a first condition, setting the host vehicle position equal to the target vehicle position;

as a second condition, setting a velocity of the host vehicle equal to zero if the target vehicle is travelling toward the host vehicle and setting the velocity of the host vehicle equal to a velocity of the target vehicle if the target vehicle is travelling away from the host vehicle;

using the positions and the conditions above, solving for a time to collision and a required host vehicle acceleration to be applied over the time to collision in order to avoid collision; and based upon the time to collision, activating a host vehicle braking system to achieve the required host vehicle acceleration.

2. A method according to claim 1, wherein the host vehicle position as a function of time is given by the expression $$p_H(t) = v_H(t_0)(t - t_0) + \frac{1}{2}a_H(t - t_0)^2$$

and the target vehicle position as a function of time is given by the expression $$p_T(t) - p_T(t_0) + v_T(t_0)(t - t_0) + \frac{1}{2}a_T(t - t_0)^2,$$

where $p_H$ is host vehicle position as a function of time, $p_T$ is target vehicle position as a function of time, $v_H$ is host vehicle velocity as a function of time, $v_T$ is target vehicle velocity as a function of time, $a_H$ is host vehicle acceleration as a function of time, $a_T$ is target vehicle acceleration as a function of time, and $t_0$ is an initial time value.

3. A method according to claim 2, wherein if the target vehicle is travelling toward the host vehicle the time to collision is calculated as $$t - t_0 - \frac{4p_T(t_0)}{2v_T(t_0) - v_H(t_0) \pm \sqrt{(v_H(t_0) - 2v_t(t_0))^2 - 8p_T(t_0)a_T(t_0)}}$$

and the required host vehicle acceleration is calculated as $$a_{H1,2}(t) = \frac{v_H(t_0)}{4p_T(t_0)}\left(2v_T(t_0) - v_H(t_0) \pm \sqrt{(v_H(t_0) - 2v_t(t_0))^2 - 8p_T(t_0)a_T(t_0)}\right).$$

4. A method according to claim 2, wherein the host vehicle position as a function of time is given by the expression $$p_H(t) - v_H(t_0)(t - t_0) + \frac{1}{2}a_H(t - t_0)^2$$

and the target vehicle position as a function of time is given by the expression $$p_T(t) = p_T(t_0) - \left(\frac{v_T(t_0)^2}{2a_T(t_0)}\right),$$

where $p_H$ is the host vehicle position as a function of time, $p_T$ is the target vehicle position as a function of time, $v_H$ is the host vehicle velocity as a function of time, $v_T$ is a target vehicle velocity as a function of time, $a_H$ is a host vehicle acceleration as a function of time, $a_T$ is a target vehicle acceleration as a function of time, and $t_0$ is an initial time value.

5. A method according to claim 2, wherein the required host vehicle acceleration needed such that at the time of collision the host vehicle is at a standstill, is $$a_H(t) = -\frac{v_H(t_0)^2}{2\left(p_T(t_0) - \frac{v_T(t_0)^2}{2a_T(t_0)}\right)}$$

and a time needed for the host vehicle to stop, $t_{HStop}$ is:

$$t_{HStop} = t_0 + \frac{2p_T(t_0)a_T(t_0) - v_T(t_0)^2}{v_H(t_0)a_T(t_0)},$$

which time $t_{HStop}$ greater than a time to stop of the target vehicle, $t_{Tstop}$, which is $$t_{TStop} = t_0 - \frac{v_T(t_0)}{a_T(t_0)},$$

if and only if $$2p_T(t_0)a_T(t_0) - v_T(t_0)^2 + v_H(t_0)v_T(t_0) > 0.$$

6. A method of operating a vehicle collision mitigation system comprising the steps of:

determining a host vehicle position ($p_H$) as a function of time, a host vehicle velocity ($v_H$) as a function of time, and a host vehicle acceleration ($a_H$) as a function of time;

determining a target vehicle position ($p_T$) as a function of time, a target vehicle velocity ($v_T$) as a function of time, and a target vehicle acceleration ($a_T$) as a function of time;

determining whether the target vehicle is travelling toward the host vehicle or away from the host vehicle;

as a first condition, setting the host vehicle position equal to the target vehicle position;

as a second condition, setting a velocity of the host vehicle equal to zero if the target vehicle is travelling toward the host vehicle and setting the velocity of the host vehicle equal to a velocity of the target vehicle if the target vehicle is travelling away from the host vehicle;

using the positions and the conditions above, solving for a time to collision and a required host vehicle acceleration to be applied during the time to collision in order to avoid or mitigate a collision between the host vehicle and the target vehicle; and based upon the time to collision, activating a host vehicle braking system to achieve the required host vehicle acceleration.

7. A method according to claim 6, wherein the target vehicle is initially travelling away from the host vehicle and the braking system is activated to slow the host vehicle such that the host vehicle velocity is equal to the target vehicle velocity at the time to collision.

8. A method according to claim 6, wherein the target vehicle is initially travelling toward the host vehicle and the braking system is activated to slow the host vehicle such that the host vehicle is at a standstill at the time to collision.

9. A method according to claim 6, wherein the required acceleration is calculated based at least in part on predetermined vehicle performance factors.

* * * * *